US012128471B2

(12) United States Patent
Chantagorn et al.

(10) Patent No.: US 12,128,471 B2
(45) Date of Patent: Oct. 29, 2024

(54) WORKPIECE EJECTING SYSTEM FOR USE IN STAMPING MACHINE

(71) Applicant: AKRIBIS SYSTEMS PTE LTD, Singapore (SG)

(72) Inventors: Udornpan Chantagorn, Singapore (SG); Paiboonsuk Kiattiphong, Singapore (SG); Yong Peng Leow, Singapore (SG)

(73) Assignee: AKRIBIS SYSTEMS PTE LTD, Singapore (SG)

( * ) Notice: Subject to any disclaimer, the term of this patent is extended or adjusted under 35 U.S.C. 154(b) by 277 days.

(21) Appl. No.: 17/642,780

(22) PCT Filed: Oct. 30, 2019

(86) PCT No.: PCT/SG2019/050532

§ 371 (c)(1),
(2) Date: Mar. 14, 2022

(87) PCT Pub. No.: WO2021/086261

PCT Pub. Date: May 6, 2021

(65) Prior Publication Data

US 2022/0314299 A1 Oct. 6, 2022

(51) Int. Cl.

| | |
|---|---|
| ***B21D 45/02*** | (2006.01) |
| ***B21D 22/02*** | (2006.01) |
| ***B21J 13/14*** | (2006.01) |

(52) U.S. Cl.

CPC ..... *B21D 45/02* (2013.01); *B21D 22/02* (2013.01); *B21J 13/14* (2013.01)

(58) Field of Classification Search

CPC ..... B21D 45/00; B21D 45/02; B21D 45/003; B21D 45/04; B21J 13/14

USPC ..... 72/344, 345

See application file for complete search history.

(56) References Cited

U.S. PATENT DOCUMENTS 3,911,719 A * 10/1975 Degenhardt ..... B21D 45/04 72/345

2021/0178540 A1* 6/2021 Wolf ..... B26D 7/1818

FOREIGN PATENT DOCUMENTS

DE 102011115508 B4 * 1/2013 ..... B21J 13/14

OTHER PUBLICATIONS

English translate (DE102011115508B4), retrieved date Feb. 6, 2024.*

* cited by examiner

*Primary Examiner* — Mohammed S. Alawadi

(74) *Attorney, Agent, or Firm* — WPAT, PC

(57) ABSTRACT

An ejecting system for a workpiece from a die cavity in a stamping machine is disclosed. The ejecting system has a spring plunger mechanism to fetch the workpiece from the die cavity of the die platen of the stamping machine. The spring plunger mechanism is provided with a picker which is integrated with a vacuum system to hold the workpiece. Underneath the spring plunger mechanism, there is an actuator, including a positioning sensor, for triggering both synchronous upward and downward movement of the linear actuator to the punch of a die set.

15 Claims, 3 Drawing Sheets

WORKPIECE EJECTING SYSTEM FOR USE IN STAMPING MACHINE

FIELD OF THE INVENTION

The present invention generally relates to workpiece ejecting system, and in particular, to an ejecting device for use in stamping machine.

BACKGROUND OF THE INVENTION

This invention will be described in its application to stamping apparatus and an ejector mechanism which received an ejected workpiece from the die set of the stamping apparatus. In conventional stamping apparatus, the ejector mechanism is used to hold the ejected workpiece between the ejector pin and a spring loaded retaining pin after the workpiece leaves the die and before it is gripped by a transfer mechanism in the stamping device.

In general, conventional types of workpiece ejector are available in the market. The first type relates to one which has a lower cam mechanism and by advancing the lever which is connected to the plunger or plunger directly in contact with cam, the workpiece is cut. For example, U.S. Pat. Nos. 5,031,439, 5,067,892, and UK Patent No. GB2, 360,235A disclose workpiece ejector. The downward movement of the punch will cause a cut workpiece being fully filled into the die. The results of such movement is to synchronously rotation of the lower cam. Then the plunger which is connected to the lower cam goes upward through the bearing guided and therefore the cut workpiece is being held. When the punch is withdrawn, the plunger goes downward associated with the rotational of cam and ejected the cut workpiece.

The other type of ejector has revealed by U.S. Pat. No. 4,628,780 is related to air ejector system. Such air ejector system is being used in a horizontal or vertical stamping press which reciprocates the moving member of a die set to produce an annular product. Air is introduced through a central punch for shedding and ejecting a slug. Air flows to blow the cut workpiece out from the die cavity. The air flow will be controlled by mechanic valves before air goes through the die set. From the upper part of die set, there is an air path which is connected to the top end of the punch. In addition, the other end of the punch also has an air hole for the air flow from its top end. When the punch goes down to cut the workpiece, the valve will be automatically activated, then air pressure will flow through the air path until the cutting area. By this consequent, the air will blow the cut workpiece out. The upward movement of the punch will cause the air path to close and block by the valve mechanism of the air ejector system.

The present invention discloses another type of ejector mechanism, wherein a spring plunger is fitted underneath a die set platen in direct alignment with the die cavity of a die. The downward movement of the punch of the stamping machine will compress compressing the spring of the plunger by a linear actuator which is being triggered by a displacement sensor from the movement of the die set. This spring plunger will partially go into the die cavity and receive the cut part. In the course of withdrawal of the punch of the ejector mechanism, the linear actuator will move down to release the spring-load and therefore the cut part is ejected.

It is common shortcoming of the conventional workpiece ejecting system that it employed a cam mechanism which is carried by the lower cam shaft of the stamping machine in order to synchronize the movement. Thus, it requires an experienced tool-setter or mechanic for such an installation, setup, tool changing, maintenance, and tooling conversion, respectively. Moreover, these tasks are physically laborious and consume machine uptime more particular when the machine and/or tooling is under development phase.

It is also a disadvantage of employing the air ejecting system that requires an air flow path at the punch component to blow a workpiece out from the die. In addition, the punch component is generally made from a cutting material such as high-speed steel. Thus, in order to drill the air path hole, the machining cost must be considered. On the other hand, there is only one configuration of the air path that it is blow out from the center of the punch. So, if the workpiece has a hole in the middle, the cut part could not be blow out. If the workpiece has an inclined surface, the air will blow part of the cut workpiece out from some angle direction.

SUMMARY OF THE INVENTION

It is therefore a primary object of the present invention to provide a workpiece ejecting system for use in a stamping machine, wherein a spring plunger mechanism which can be fitted and aligned to the die cavity (111) which is positioned beneath a die platen in more accessible and is less machine down-time.

A main object of the present invention is to provide a workpiece ejecting system for use in stamping machine comprising:

a die platen (10) linked to a punch (110) and having a die cavity (111) for holding a workpiece to be ejected therefrom; a picker (20) vertically aligned with the die cavity (111) on the die platen (10), wherein the die cavity (111) has the shaped of the workpiece and is adaptable to hold the workpiece, and the workpiece is held by using a vacuum system; a linear guide bushing (30) in vertical alignment with the picker (20) to guide the direction of either upward and downward movement of the picker (20); a floating base (40) being used for mounting the linear guide bushing (30) and for integrating with an outsource stage and/or actuator such as a linear actuator and a rotary actuator for a purpose of transferring and or conveying to a further process; a linear guide shaft (50) vertically mounted to the linear guide bushing (30) which moves upward and downward direction to push the picker (20); a spring cap (60) connected to the linear guide shaft (50) for restricting the maximum travel of the linear guide shaft (50) vertically and for holding a loaded spring (80) in the linear guide shaft (50), wherein the load spring (80) is vertically aligned to the linear guide shaft (50) the linear guide bushing (30) and the picker (20) to hold the picker (20) to be seated properly on the floating base (40) and to accelerate a downward movement of the picker (20); and a positioning sensor (90) integrated with the linear actuator (70) for measuring and triggering both the upward and downward of the movement of the linear actuator (70) as well as a spring plunger mechanism, thereby the workpiece is ejected directly from the die cavity (111) to the picker (20) and is then transferred to a packaging machine to pack the workpiece.

Still a further object of the present invention is to provide a workpiece ejecting system, wherein the floating base (40) is used to hold the workpiece ejecting system, and the floating base (40) can be integrated with the outsource stage and/or actuator either linear or rotary actuator.

Yet still another object of the present invention to provide a workpiece ejecting system, wherein the positioning sensor (90) is integrated to the linear actuator (70) such that when the positioning sensor (90) detects the movement of the punch (110). For a downward the movement of the punch (100), the linear actuator (70) will be triggered by the positioning sensor (90) to move up and when the punch (110) moving up movement will trigger the linear actuator (70) to go down.

Another object of the present invention is to provide a workpiece ejecting system, wherein the upward movement is performed by the pushing force of the linear actuator (70) against the loaded spring (80) of the spring plunger mechanism.

Yet a further object of the present invention is to provide a workpiece ejecting system, wherein the downward movement is associated by downward movement of the linear actuator (70) and releasing force of the loaded spring (80) of the spring plunger mechanism, and the spring plunger mechanism is located directly underneath of the die platen (10) but above the position of the linear actuator (70). The spring plunger mechanism is adjustable to provide a stroke based on the height of the die platen (10) to the die cavity (111) by increasing the length of the linear guide shaft (50) and the loaded spring (80).

Another object of the present invention is to provide a workpiece ejecting system, wherein the picker (20) is interchangeable to an alternative picker designed based on the size and/or shape of the workpiece (not shown), and a vacuum system is integrated to the picker (20) to hold a workpiece in place on the top surface of the picker (20) of the ejecting system.

Still yet another object of the present invention is to provide a workpiece ejecting system, wherein a plurality of holes are provided on the top surface of the picker for holding a workpiece and the holes are arranged or positioned based on the shape of the workpiece.

Further object of the present invention is to provide a workpiece ejecting system, wherein the positioning sensor is integrated together with the actuator.

An important feature of this present invention is to provide a workpiece ejector which is easy to install and good accessibility during tooling conversion.

In one aspect of the primary object of this present invention is to provide a linear actuator to compress the spring mechanism of workpiece ejector while it is moving upward and downward and releasing the spring-loaded, respectively.

It is yet another objective of this present invention to provide a workpiece ejecting system which the linear actuator is isolated from the workpiece ejector. The said workpiece ejector is not restricted to a single module, but also multiple modules.

Another object of this present invention is to provide a workpiece ejector which can be installed on a stage which is underneath the die platen such for transferring or pick and place.

A further object of the present invention is to provide a workpiece ejector with vacuum system in order to hold the cut workpiece in position.

Other features, additional objects, and many of the attendant advantages of this invention will readily be appreciated as the same becomes better understood by reference to the following detailed description of a preferred embodiment and a modification thereof when considered in combination with the appended drawing in which:

DETAILED DESCRIPTION OF THE PREFERRED EMBODIMENTS

Figure 1B:
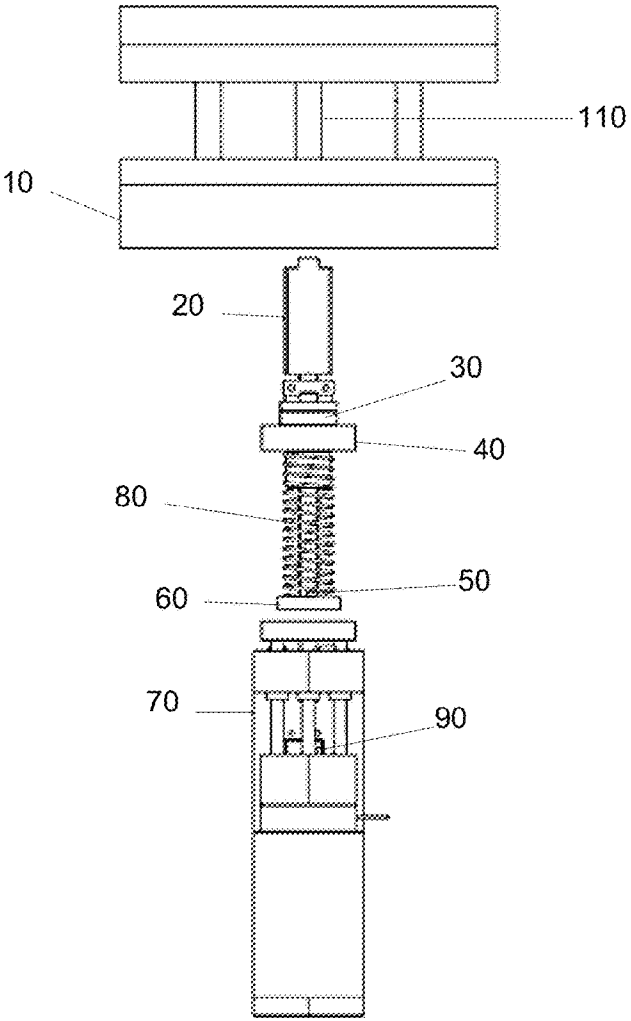
FIG. 1B is a front view of the workpiece ejecting system in accordance with the present invention.

Referring to the drawing the depicted apparatus is designed for an ejecting system of stamping tool in a stamping machine. The ejecting system, as shown in FIGS. 1A and 1B, is constructed according to a preferred embodiment of the present invention.

Figure 1A:
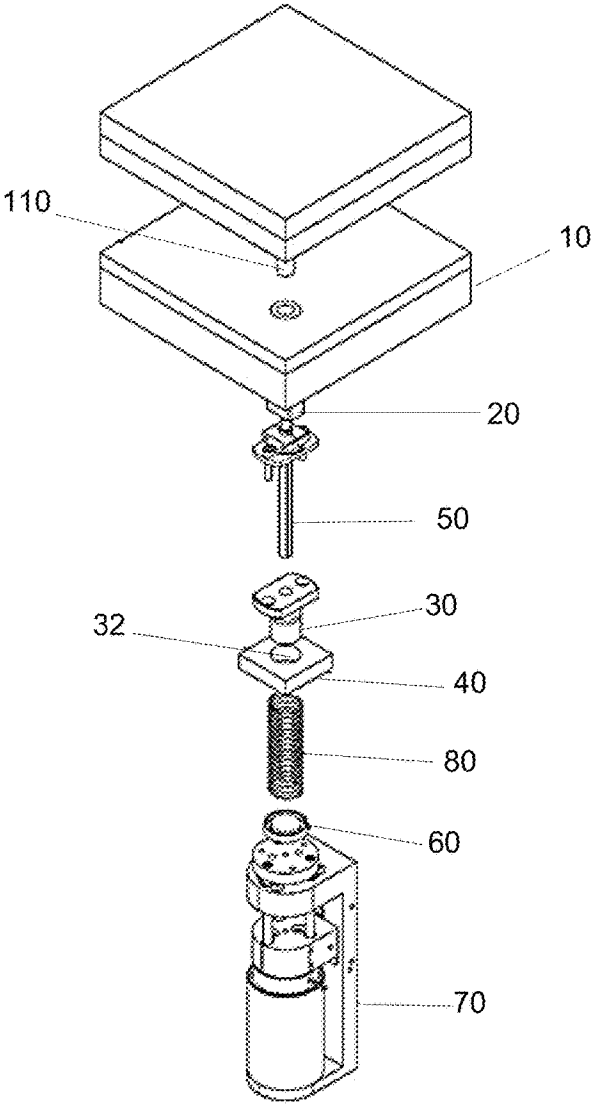
FIG. 1A is a perspective view of a work piece ejecting system for use in stamping machine of the present invention.

As shown in FIGS. 1A and 1B, the ejecting system (100) comprises a die platen (10), a picker (20), a linear guide bushing (30), a floating base (40), a linear guide shaft (50), a spring cap (60), a linear actuator (70), a loaded spring (80), and a positioning sensor (90). FIG. 1A is a perspective view of a work piece ejecting system (100) for use in stamping machine (not shown) of the present invention, and FIG. 1B is a sectional view of the workpiece ejecting system (100).

In the preferred embodiment of the present invention, the workpiece ejecting system (100) is arranged in vertical and the picker (20); the linear guide bushing (30); the linear guide shaft (50); the spring cap (60); and the loaded spring (80) form into a spring plunger mechanism. The stamping tool (not shown) of the stamping machine is positioned on the top surface of the die platen (10), which is a flat horizontal plate, and the spring plunger mechanism is located on the floating base (40), which has a through hole (32) to hold the linear guide bushing (30). In accordance with the present invention, the floating base (40) is underneath of the die platen (10) and, moreover, the floating base (40) can be integrated with an additional stage and/or an actuator for the purpose of transferring the ejecting workpiece out from the die platen (10).

The linear guide shaft (50) having two ends passes through the load spring (80), and the spring (80) is held by the spring cap (60) at one end thereof.

Below the spring plunger mechanism is the linear actuator (70) which is arranged vertically to the spring plunger mechanism. The linear actuator (70) is used for the upward or downward movement of the ejecting system.

Figure 2:
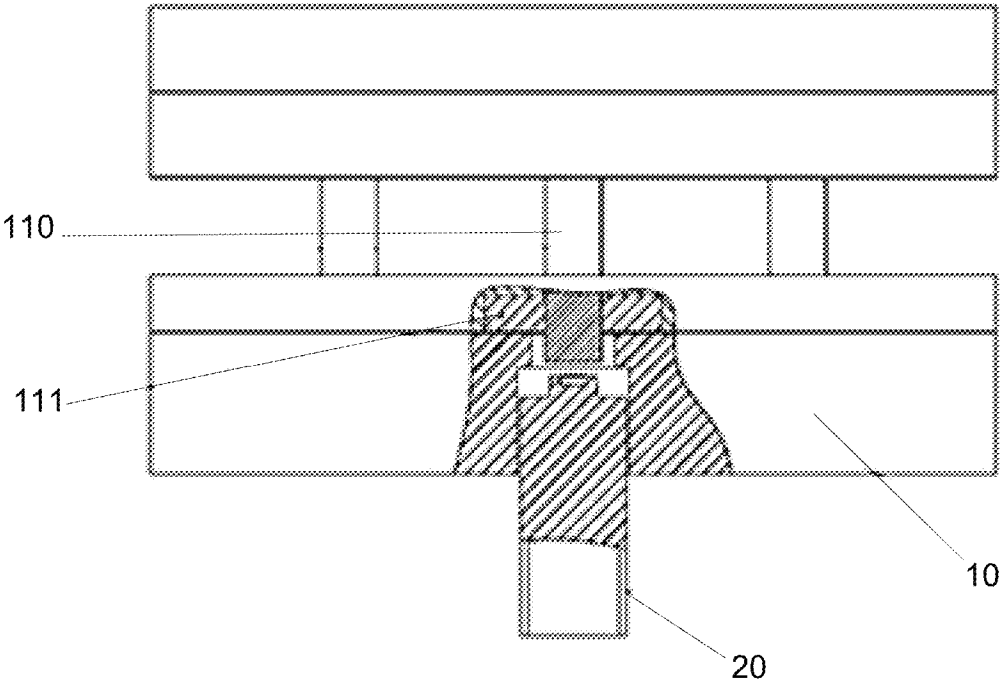
FIG. 2 is a partial section view of the die cavity of the workpiece ejecting system in accordance with the present invention.
Figure 3D:
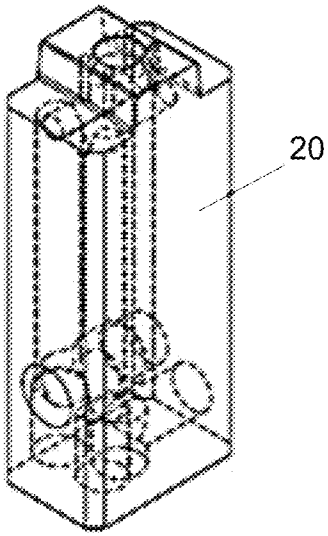
FIG. 3D is a schematic perspective view of the picker of the workpiece ejecting system in accordance with the present invention.
Figure 3B:
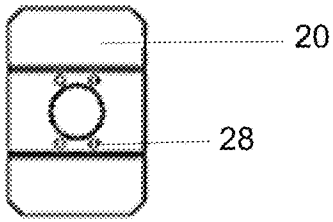
FIG. 3B is the top view of the picker of the workpiece ejecting system, wherein a plurality of holes are used to hold a workpiece when the vacuum system is in operation in accordance with the present invention.
Figure 3C:
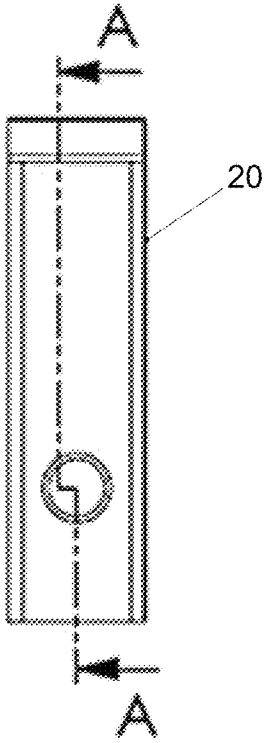
FIG. 3C is the front view of the picker of the workpiece ejecting system in accordance with the present invention.
Figure 3A:
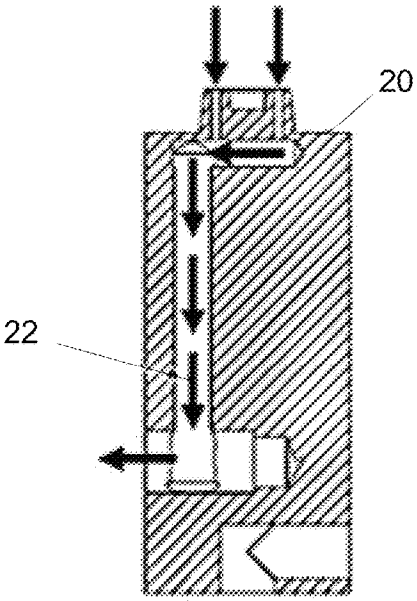
FIG. 3A is a section view of the picker of the workpiece ejecting system, showing the air path within the picker for a vacuum system in accordance with the present invention.

FIG. 2 is a partial section view of the die cavity (111) of the workpiece ejecting system (100) in accordance with the present invention and FIG. 3A is a section view of the picker (20) of the workpiece ejecting system (100), showing the air path (22) within the picker (20) for a vacuum system in accordance with the present invention.

In operation, the downward movement of the ejecting system starts with the downward moving of the punch (110). The positioning sensor (90) which is integrated to the linear actuator (70) triggers the linear actuator (70) to push the spring cap (60) upward. While the spring cap (60) moves upward, the loaded spring (80) is compressed, and the linear guide shaft (50) that mounted together with the spring cap (80) moves upward through the linear guide bushing (30). Consequently, the picker (20) which is mounted in vertically aligned with the linear guide shaft (50) will move up to fetch a workpiece (not shown) from the die cavity (111) above the die platen (10) as shown in FIG. 2. When the ejecting workpiece drops from the die cavity (111), vacuum is generated by a vacuum system in the picker (20) in order to hold the ejecting workpiece in position.

FIG. 3B is the top view of the picker (20) of the workpiece ejecting system, wherein a plurality of holes (28) are used to hold a workpiece when the vacuum system is in operation in accordance with the present invention. FIG. 3C is the front view of the picker (20) of the workpiece ejecting system in accordance with the present invention and FIG. 3D is a schematic perspective view of the picker (20) of the workpiece ejecting system in accordance with the present invention.

When the punch (110) withdraws from the die cavity (111), the positioning sensor (90) triggers the linear actuator (70) to move downward. Hence, the loaded spring (80) with loads is released and, therefore, pushing the spring cap (60) to move downward. Then, the linear guide shaft (50) which is connected to the spring cap (60) will move simultaneously together with the picker (20) and the ejecting workpiece. Once the picker (20) is completely held on the linear guide bushing (30), the workpiece will be ejected from the die cavity (111) and ready for transferring or perform the next packaging process or the like.

The advantages of the described embodiment compared to conventional workpiece ejecting system are:

1. The workpiece is ejected directly from the die cavity (111) to the picker, and, hence, the ejecting workpiece can be transferred or conveyed to other assembly to proceed with other processes, or to other machine and/or packaging carefully without part to part contact.
2. In the preferred embodiment, an ejecting system was formed by less complex components. Therefore, the task of maintenance, replacement, and/or conversion required less experience technician or operator. Accordingly, the downtime and lost production are significantly reduced.
3. The workpiece ejecting system is located on the floating base (40) which can be integrated into an outsource stage and/or an actuator, for example, but not limit to, linear actuator and/or rotary actuator for the purpose of transferring or conveying the workpiece to another machine and/or process.
4. Since the ejecting system having a linear actuator with positioning sensor underneath, the height of spring plunger can be measured, and adjustment can be made to suit the die platen level and die cavity (111) height.
5. The picker with integrated vacuum system can be designed and modified according to the workpiece shape and/or die cavity (111).

It will be appreciated by persons skilled in the art that the present invention is not limited by what has been particularly shown and described hereinabove. Rather the scope of the present invention includes both combinations and subcombinations of the various features described hereinabove as well as variations and modifications which would occur to persons skilled in the art upon reading the specification and which are not in the prior art.

The invention claimed is:

1. A workpiece ejecting system for use in a stamping machine comprising:

(a) a die platen (10) linked to a punch (110) and having a die cavity (111) for holding a workpiece to be ejected therefrom;

(b) a picker (20) vertically aligned with the die cavity (111) on the die platen (10), wherein the die cavity (111) has the shaped of the workpiece and is adaptable to hold the workpiece, and the workpiece is held by using a vacuum system;

(c) a linear guide bushing (30) in vertical alignment with the picker (20) to guide the picker (20) in either an upward movement or a downward movement;

(d) a floating base (40) being used for mounting the linear guide bushing (30);

(e) a linear actuator (70) which is located underneath of a spring plunger mechanism and generates a vertical movement against the spring plunger mechanism;

(f) a linear guide shaft (50) having two ends and vertically slide along with the linear guide bushing (30) while guiding the picker (20);

(g) a spring cap (60) connected to the linear guide shaft (50) for restricting a maximum travel of the linear guide shaft (50) vertically and for holding a loaded spring (80) of the spring plunger mechanism in the linear guide shaft (50), wherein the load spring (80) is vertically aligned to the linear guide shaft (50), the linear guide bushing (30) and the picker (20) to hold the picker (20) to be seated on the floating base (40) and to accelerate the downward movement of the picker (20); and (h) a positioning sensor (90) integrated with the linear actuator (70) for triggering the vertical movement of the linear actuator (70) and the spring plunger mechanism, respectively, thereby the workpiece is moved from the die cavity (111) to the picker, and is then, with an outsource stage for transferring to a packaging machine to pack the workpiece.

2. The workpiece ejecting system as set forth in claim 1, wherein the spring plunger mechanism comprises: the picker (20) vertically mounted onto a first end of the linear guide shaft (50), which slides along a hole (32) of the linear guide bushing (30), the floating base (40), and the load spring (80), and the spring cap (60) is mounted onto a second end of the linear guide shaft (50) to hold the load spring (80).

3. The workpiece ejecting system as set forth in claim 2, wherein the outsource stage includes a rotary actuator.

4. The workpiece ejecting system as set forth in claim 1, wherein the positioning sensor (90) is integrated to the linear actuator (70) such that when the positioning sensor (90) detects the movement of the punch (110), and triggers the linear actuator (70) to push the spring plunger mechanism up when the punch (110) goes down, and to release the load spring (80) of the spring plunger mechanism when the punch (110) is withdrawing from the die cavity (111).

5. The workpiece ejecting system as set forth in claim 1, wherein the upward movement is performed by the linear actuator pushing (70) against the load spring (80) of the spring plunger mechanism.

6. The workpiece ejecting system as set forth in claim 1, wherein the downward movement is associated by the linear actuator (70) releasing the load spring (80) of the spring plunger mechanism.

7. The workpiece ejecting system as set forth in claim 1, wherein the floating base (40) is used to hold the workpiece ejecting system, and the floating base (40) is integrated with the outsource stage and/or the actuator.

8. The workpiece ejecting system as set forth in claim 1, wherein the spring plunger mechanism is located directly underneath of the die platen (10) but above a position of the linear actuator (70).

9. The workpiece ejecting system as set forth in claim 1, wherein the spring plunger mechanism is adjustable to provide a stroke based on a height of the die platen (10) to the die cavity (111) by increasing a length of the linear guide shaft (50) and the load spring (80).

10. The workpiece ejecting system as set forth in claim 1, wherein the picker (20) is interchangeable with an alternative picker design for accommodating different shapes and sizes of the workpiece and the die cavity (111).

11. The workpiece ejecting system as set forth in claim 1, wherein the vacuum system is integrated to the picker (20) to hold the workpiece in place on a top surface of the picker.

12. The workpiece ejecting system as set forth in claim 11, wherein a plurality of holes (28) are provided on the top surface of the picker (20) for holding the workpiece.

13. The workpiece ejecting system as set forth in claim 12, wherein the plurality of holes are provided on the top surface of the picker (20) are arranged or positioned based on a shape of the workpiece.

14. The workpiece ejecting system as set forth in claim 1, wherein the positioning sensor (90) is positioned within the linear actuator (70).

15. The workpiece ejecting system as set forth in claim 14, wherein the picker (20) is moveable into the die cavity (111) to fetch the workpiece.

* * * * *